United States Patent [19]

Piegza et al.

[11] Patent Number: 4,567,811

[45] Date of Patent: Feb. 4, 1986

[54] TELESCOPIC CYLINDER

[75] Inventors: Henry J. Piegza, Clarence; Richard A. Zielinski, Orchard Park, both of N.Y.

[73] Assignee: WSF Industries, Inc., Tonawanda, N.Y.

[21] Appl. No.: 748,028

[22] Filed: Jun. 24, 1985

Related U.S. Application Data

[63] Continuation-in-part of Ser. No. 633,493, Jul. 23, 1984, abandoned.

[51] Int. Cl.[4] ..... F01B 7/20

[52] U.S. Cl. ..... 91/169; 92/52; 92/53; 91/508

[58] Field of Search ..... 92/108, 52, 53, 51; 91/169, 168, 216 R, 508

[56] References Cited

U.S. PATENT DOCUMENTS

| | | | |
|---|---|---|---|
| 1,482,256 | 1/1924 | Prall | 91/169 |
| 2,533,959 | 12/1950 | Rothschild | 92/52 |
| 2,720,865 | 10/1955 | Perdue | 91/169 |
| 3,010,752 | 11/1961 | Geffner | 92/51 |

FOREIGN PATENT DOCUMENTS

| | | | |
|---|---|---|---|
| 113614 | 6/1901 | Fed. Rep. of Germany | 92/52 |

*Primary Examiner*—Paul E. Maslousky

*Attorney, Agent, or Firm*—Bean, Kauffman & Bean

[57] ABSTRACT

A fluid operated cylinder device particularly adapted to lift a load relative to a load support includes a hollow casing having a closed end for attachment to the load support; an elongated rigid rod extending lengthwise of the casing and having a first end arranged within the casing and rigidly fixed to its closed end and a second end disposed outwardly of the casing for attachment to the load support; at least one open ended fluid operated cylinder arranged intermediate the casing and rod for sliding movements lengthwise thereof, such cylinder having an outer end disposed outwardly of the casing for attachment to the load; and fluid means for introducing and withdrawing fluid from the casing for effecting sliding movements of the cylinder and lifting and lowering of the load. Single and double acting embodiments of the cylinder device are disclosed.

12 Claims, 5 Drawing Figures

TELESCOPIC CYLINDER

REFERENCE TO RELATED APPLICATION

The present application is a continuation-in-part of U.S. patent application Ser. No. 633,493, filed July 23, 1984 and now abandoned.

BACKGROUND OF THE INVENTION

Heretofore, single and double acting hydraulically operated cylinders have been widely used for lifting and lowering loads relative to load supports of various types.

While, for many installations, conventional cylinders perform satisfactorily, there are two instances where serious installation and/or operating problems are encountered. A first instance involves an installation, wherein a single cylinder is employed to lift a relatively heavy load, such as the door or shell of a pressure vessel, wherein the path of movement of such load is offset from the path of movement or axis of the piston rod of the cylinder. Problems of bending deformation of such piston rod increase with increases in the weight of the load, the distance between the paths of movement of the load and piston rod and the required length of piston rod travel. Solutions to such problems commonly include the provision of over-size cylinders, provision of special guides to constrain movement of the load to its prescribed path of travel and attempts to align the paths of travel of the load and piston rod.

A second instance involves an installation, wherein the weight of a load is such as to require that two or more cylinders be arranged in parallel and be synchronously operated. The need for providing for like movements or displacements of the piston rods of paired cylinders in order to prevent canting of the load and/or unequal bending of the piston rods is well recognized, but impossible to accomplish in many installations even when the hydraulic fluid control circuit is provided with special flow control valves in an effort to achieve balanced operation conditions in the cylinders.

SUMMARY OF THE INVENTION

The present invention is directed to a hydraulic cylinder device particularly adapted for load lifting purposes in installations requiring that the line of action of a lift cylinder be offset from the path of travel of a load and/or that paired cylinders be employed to lift a given load, due to the weight thereof.

In the preferred form of the present construction, a cylinder device includes a hollow casing having a closed end rigidly fixed to a load support; an elongated rigid rod extending lengthwise of the casing and having a first end arranged within the casing and rigidly fixed to its closed end and a second end disposed outwardly of the casing and rigidly fixed to the load support; at least one open ended fluid operated cylinder arranged intermediate the casing and rod for sliding movements lengthwise thereof, wherein an outer end of such cylinder is rigidly fixed to the load; and fluid means for introducing and withdrawing fluid from the casing for effecting sliding movements of the cylinder and lifting and lowering of the load.

With the present construction, the rod, which has its opposite ends fixed to the load support, serves as the primary support and guide for the cylinder which in turn supports the load. Constraining the ends of the rod serves to transfer loadings directly to the load support, which cooperates with the strength of the rod to resist deformation or other movement of the rod under all loading conditions, so as to allow relatively large, offset loads to be lifted by the present cylinder device without resort to special guides for constraining movement of the load. Further, as opposed to conventional fluid cylinder installations, bending movements applied to the rod decrease as the cylinder is extended for load lifting purposes, since extending movements of the cylinder bring its point of attachment to the load progressively closer to the anchored outer end of the rod.

For installations wherein required load travel is relatively large or more than one load is desired to be lifted by the present cylinder device, one or more additional cylinders may be fitted between the rod and casing for independent, mutually supportive sliding movements.

The cylinder device of the present invention also possesses particular utility when used in paired, parallel cylinder device installations, in that the load carrying cylinders are preferably rigidly interconnected such that same are constrained for conjunctive or uniform operating movements, such as to minimize the need for special flow control valves to achieve balanced cylinder operating conditions.

A first embodiment of the cylinder device features a single acting cylinder design initially disclosed in above-mentioned patent application Ser. No. 633,493.

A second embodiment of the cylinder device features a double acting cylinder design.

DRAWINGS

The nature and mode of operation of the present invention will now be more fully described in the following detailed description taken with the accompanying drawings wherein.

DETAILED DESCRIPTION

Figure 1:
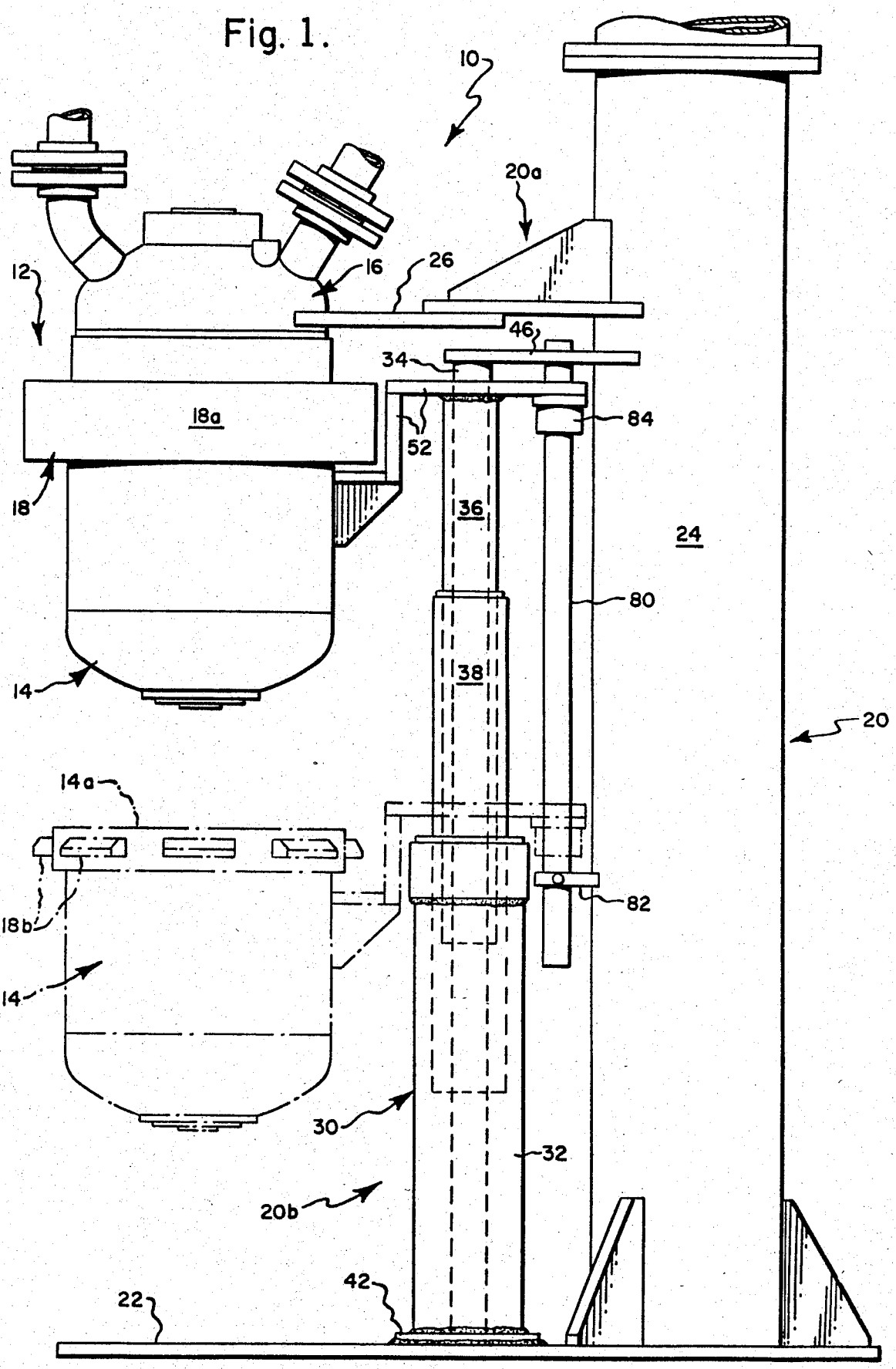
FIG. 1 is a side elevational view of a pressure vessel installation embodying the present invention.

Reference is first made to FIG. 1, wherein a pressure vessel installation formed in accordance with a presently preferred form of the invention is designated as 10, and shown as generally including a pressure vessel 12 having a hollow shell 14 formed with an upwardly facing access opening 14*a*, a door or closure 16 for closing opening 14*a* and locking means 18 for releasably securing door 16 in access opening closed position; and mounting means 20 adapted for mounting shell 14 and door 16 for relative movement between access opening closed and open positions.

The construction of vessel 12 may be conventional, but preferably is of the quick opening type described for example in commonly assigned U.S. Pat. No. 4,334,633, wherein locking ring means 18 includes a locking ring 18*a* rotatably supported by either door 16, as shown, or by shell 14 and adapted to cooperate with locking lugs 18*b* carried by the other of such door and shell. Moreover, while in the illustrated construction, door 16 is shown as being stationary and vessel 14 as being movable relative thereto between the access opening closed and open positions shown in full and broken line in FIG. 1, it will be understood that the shell may be stationary and the door supported for movement, dependent upon vessel installation and operating requirements.

Again referring to FIG. 1, it will be understood that mounting means 20 generally comprises a first or load supporting means 20*a* for mounting door 16 in a fixed position and a second or load lifting means 20*b* for mounting shell 14 for vertically directed reciprocating movements between its open and closed positions.

First means 20*a* is shown as including a support base, such as may be defined by a flat, rigid metal plate 22; a vertically extending, rigid standard, such as may be defined by a tubular, metal column 24 having its lower end suitably affixed, as by welding, to plate 22; and a rigid, cantilever arm 26 having its opposite ends suitably affixed to door 16 and the upper end of column 24, as by welding.

Figure 2:
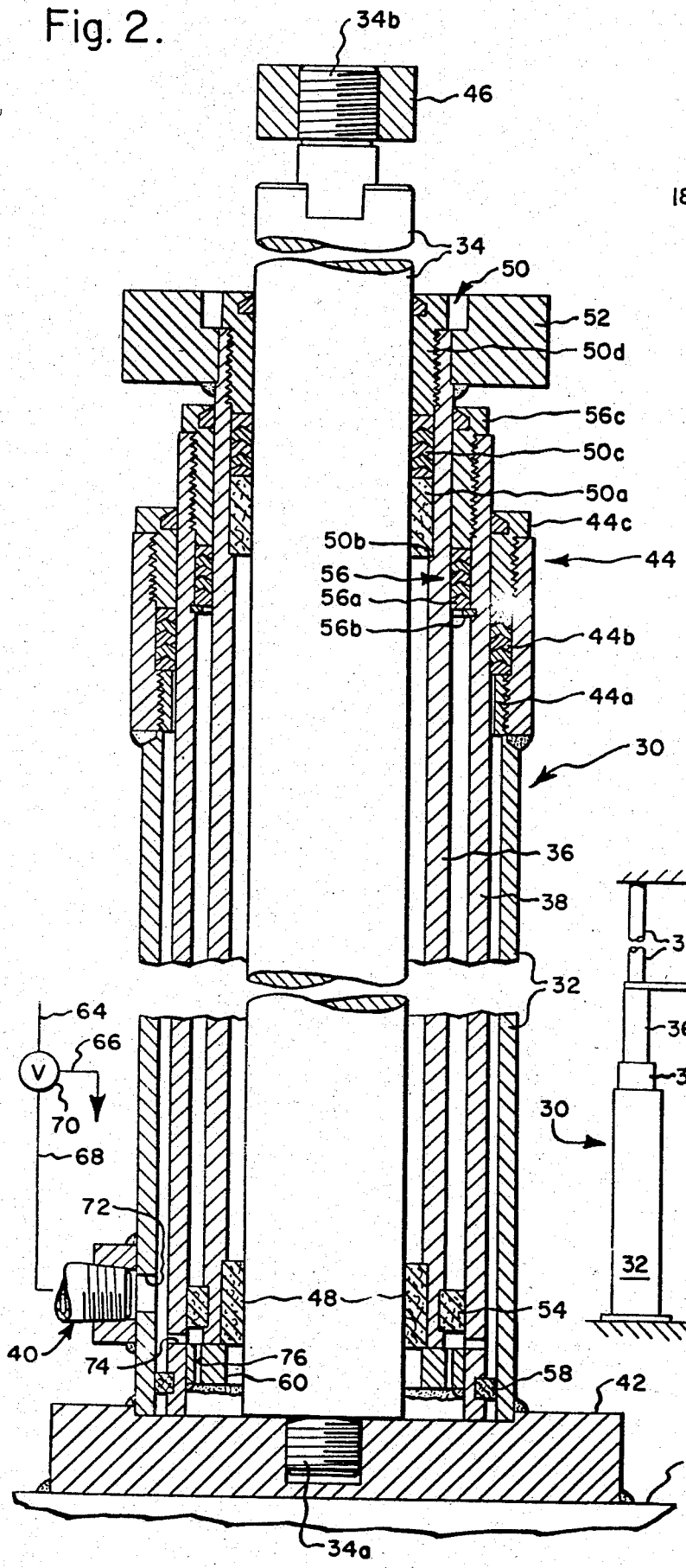
FIG. 2 is an enlarged vertical sectional view of a single acting version of the hydraulic cylinder device shown in FIG. 1.

Second or load lifting means 20*b* is preferably in the form of a fluid operated cylinder device 30, which in accordance with a first embodiment of the present invention is best shown in FIG. 2, generally includes a hollow metal casing 32; a rigid, elongated metal rod 34; first and second open ended, metal cylinders 36 and 38; and fluid control means 40 for introducing hydraulic fluid into the withdrawing such fluid from casing 32. Casing 32 is shown as having a lower end closed by a metal mounting block 42 suitably fixed to both the casing and plate 22, as by welding, and an open upper end bounded by a fluid packing gland and slide bearing device 44 defined for instance by an inner threadably mounted stop ring 44*a*, packing rings 44*b* and an inner, threadably mounted clamping-bearing ring 44*c*. Rod 34, which is arranged to extend lengthwise and concentrically of casing 32, has a first or lower end rigidly fixed to mounting block 42, such as by a screw threaded connection 34*a*, and a second or upper end rigidly fixed to the upper end of column 24, such as by a cantilever arm 46 and a threaded connection 34*b*.

The lower and upper ends of first cylinder 36 are slidably supported on rod 34 by supporting means including a lower bearing ring 48 and an upper fluid packing gland and slide-bearing device 50 defined for instance by an inner bearing ring 50*a* seated against a shoulder 50*b*, fluid packing rings 50*c* and an outer threadably mounted, clamping-bearing ring 50*d*. The upper or outer end of cylinder 36 is rigidly connected to shell 14 by a suitable weld-affixed bracket 52. Cylinder 36 is slidably supported relative to casing 32 by supporting means including second cylinder 38. Additionally, such supporting means includes a lower bearing ring 54 carried by the lower end of cylinder 36 and a fluid packing gland and slide-bearing device 56 defined for instance by fluid packing rings 56*a* seated against a snap ring 56*b* and an outer threadably mounted clamping-bearing ring 56*c*, which cooperate to guide and provide a fluid seal between cylinders 36 and 38. Cylinder 38 in turn has its outer surface slidably supported relative to casing 32 by means of the above described slide bearing device 44 and a lower bearing ring 58 carried adjacent its lower end for sliding engagement with casing 32. A rigid abutment in the form of a ring 60 is fixed, as by welding, inwardly of the lower end of cylinder 38 for abutting engagement with the lower end of cylinder 36.

Cylinder 38 may be considered as having inner motion limiting means, which are arranged adjacent its inner and outer ends and defined by ring 60 and snap ring 56*b*, and outer motion limiting means, which is arranged adjacent its inner end and defined by its inner annular end surface and bearing ring 58. Cylinder 36 may in turn be considered as having outer motion limiting means, which is arranged adjacent its inner end and defined by its inner annular end surface and bearing ring 54. It will be apparent from viewing FIG. 2 that the inner annular end surface of cylinder 36 and bearing ring 54 are arranged to alternatively engage with ring 60 and snap ring 56*b* to define the maximum permissible extent of movement of cylinder 36 relative to cyllinder 38; and that the inner annular surface of cylinder 38 and bearing ring 58 are arranged to alternatively engage with the closed end of casing 32, as defined by block 42, and stop ring 44*a* to define the maximum permissible extent of movement of cylinder 38 relative to casing 32.

By again making reference to FIG. 2, it will be seen that fluid control means 40 includes a fluid supply conduit 64 adapted to be connected to a suitable source of operating fluid, such as pressurized hydraulic fluid, not shown; a dump or drain conduit 66; and a supply-discharge conduit 68, which has one end alternatively placed in flow communication with conduits 64 and 66 by means of a suitable control valve 70 and a second end disposed in flow communication with the interior of casing 32 via an opening 72 arranged adjacent the closed lower end thereof, a first flow aperture(s) 74 extending radially through the lower end of cylinder 38 at a point immediately above ring 60, and a second flow aperture(s) 76 extending axially through ring 60 radially intermediate cylinders 36 and 38. Valve 70 may be of any suitable construction and be manually or remotely controlled depending upon installation operating requirements.

Further, in accordance with the preferred form of the invention, shell 14 is constrained for axially directed reciprocating movements in alignment with door 16 by means including a guide rod 80 rigidly fixed to standard 24 by cantilever arm 46 and a lower mounting bracket 82; and a sleeve bearing device 84, which is fixed to bracket 52 and slidably receives rod 80. This arrangement serves principally to prevent misalignment of the shell and door and is not intended to be relied upon to carry loads to the standard.

To facilitate description of the mode of operation of the present invention employing the single acting-cylinder design of FIG. 2, it will be assumed that shell 14 is in its fully open position shown in broken line in FIG. 1, coincident with which cylinders 36 and 38 assume their retracted positions shown in FIG. 2, wherein the lower end of cylinder 38 bottoms out on mounting block 42 and the lower end of cylinder 36 bottoms out on ring 60. In this condition, valve 70 serves to place conduit 68 and thus the interior of casing 32 in flow communication with conduit 66 or alternatively to interrupt flow communication between conduit 68 and both of conduits 64 and 66, depending upon the construction of valve 70.

When it is desired to move or lift shell 14 upwardly into its access opening closed position shown in full line in FIG. 1, valve 70 is operated to place conduits 64 and 68 in flow communication and thereby introduce fluid under pressure into the interior of casing 32. As a result, cylinders 36 and 38 are forced to slide upwardly relative to casing 32 and rod 34 until they assume their fully extended positions depicted in FIG. 1, which may be defined for instance by abutting engagement between rings 58 and 44*a* and rings 54 and 56*b*. Alternatively, exterior stop devices, not shown, may be employed to arrest extending movements of the cylinders for those instances wherein shell 14 arrives at its closed position prior to the arrival of the cylinders at their fully extended positions. Such stop devices may be made adjustable to facilitate installation of the pressure vessel 12 and cylinder device 30, and if desired constructed in a manner serving to cushion the seating of shell 14 against door 16. Arrival of shell 14 at its closed position may be determined visually or by suitable sensing means, not shown, whereafter locking ring 18*a* would be rotated, either manually or by a suitable drive means, also not shown, to engage with locking lugs 18*b* for purposes of locking the shell in its closed position. Thereafter, as desired, conduit 68 may remain in flow communication with conduit 64 or valve 70 operated to block such conduit relative to both of conduits 64 and 66.

When it is desired to again open vessel 12 by returning shell 14 to its initial lower position, locking ring 18*a* is first rotated into its initial unlocked position to disengage with locking lugs 18*b* and thereby free the shell for opening movement. Thereafter, valve 70 is operated to place conduit 68 in flow communication with conduit 66 to permit the draining or discharge of fluid from casing 32 and movement of cylinders 36 and 38 to their initial retracted positions under the weight of shell 14 and its contents to complete a cycle of operation.

Figure 3:
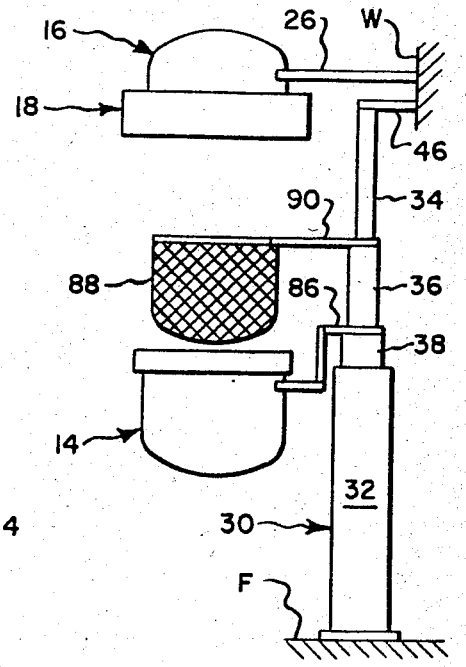
FIG. 3 is a reduced size side elevational view showing an alternative installation.

An alternative installation is illustrated in FIG. 3, wherein elements thereof, which are similar to those described with reference to FIG. 1, are illustrated by like numerals. This installation differs from that illustrated in FIG. 1, primarily in that shell 14 is carried by cylinder 38 via a suitable bracket 86; cylinder 36 is employed to removably support a basket or other fixture 88 desired to be removably supported within the shell; and the first or load supporting means is simply comprised of the wall "W" and the floor "F" of a building in which the installation is housed. Basket 88 may be removably attached to cylinder 36 by any suitable means, such as by a bracket 90 which is rotatably mounted on the upper end of the cylinder for movement into and out of vertical alignment with shell 14 and provided on its free swinging end with suitable means, such as hooks, not shown, adapted to removably attach the bracket to the basket.

Operation of the installation depicted in FIG. 3 would be identical to that of the installation described with reference to FIGS. 1 and 2 from the standpoint of effecting movements of shell 14 between its open and closed positions, except that only cylinder 38 is adapted to be driven into its retracted position under the load defined by shell 14, basket 88 and its contents. If the weight of cylinder 36 is not sufficient to effect retraction thereof when fluid is exhausted from casing 32, the upper end of cylinder 36 may be fitted with an additional weight(s), not shown. After shell 14 has been placed in its open position, basket 88 may be lifted therefrom by swinging bracket 90 to overlie the basket, effecting attachment of the bracket to the basket and finally introducing hydraulic fluid into casing 32 in an amount sufficient to extend cylinder 36 for purposes of removing the basket from within the confines of the shell without effecting extension of cylinder 38. In a typical installation, the weight of shell 14 carried by cylinder 38 would far exceed the weight of basket 88 and its contents carried by cylinder 36, and thus cylinder 38 would tend to remain stationary when fluid is introduced into casing 32 for purposes of extending cylinder 36 and lifting the basket from within the shell. However, for installations where the cylinders are more equally loaded, a suitable removable stop device, not shown, may be employed to temporarily constrain cylinder 38 from extending movements.

If desired, bracket 84 may then be swung for purposes of moving basket 88 to a convenient loading/unloading position remote from shell 14. Upon repositioning of basket 88 in alignment with shell 14, hydraulic fluid is again exhausted from casing 32 to effect retraction of cylinder 36 and the return of the basket to its sealed position within the shell. After disconnecting bracket 90 from basket 88, it is swung to its original position to permit return of shell 14 to its closed position upon the reintroduction of hydraulic fluid into casing 32.

Figure 4:
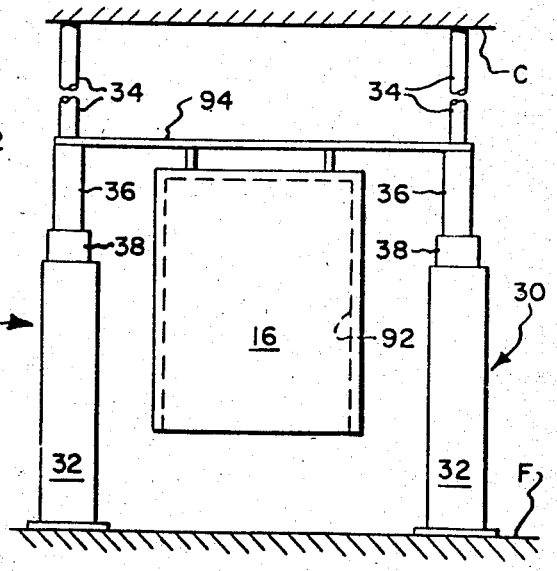
FIG. 4 is a reduced size elevational view showing a further alternative installation.

A further alternative installation is depicted in FIG. 4, wherein like numerals are employed to designate elements similar to those described above with reference to FIG. 1. In this installation, a pair of fluid cylinder devices 30 and 30 are arranged in parallel and cooperate to lift any desired load, such as a door 16 arranged to cover an opening 82 when in its illustrated lowered position. The cylinder devices may be suitably mounted, such as by having their casings 32 and 32 rigidly fixed to floor "F" and their rods 34 and 34 rigidly fixed to a ceiling or overhead beam "C", with cylinders 36 and 36 being rigidly interconnected or fixed to one another, such as by a door mounting cross beam 94. Operation of this installation is similar to that described with reference to FIG. 1, namely, the introduction of hydraulic fluid into casings 32 and 32 serving to effect extension of cylinders 36 and 38 for purposes of lifting a desired load, such as door 16, and the subsequent exhausting of such hydraulic fluid permitting the load to return the cylinders to their retracted positions. The use of two cylinder devices whose cylinders 36 and 36 are rigidly coupled, has a decided advantage over conventionally used pairs of either single or double acting cylinders in that for many installations no special balancing valves need be provided in an attempt to effect uniform extension of such cylinders to avoid cocking of door 16, as same is lifted.

Figure 5:
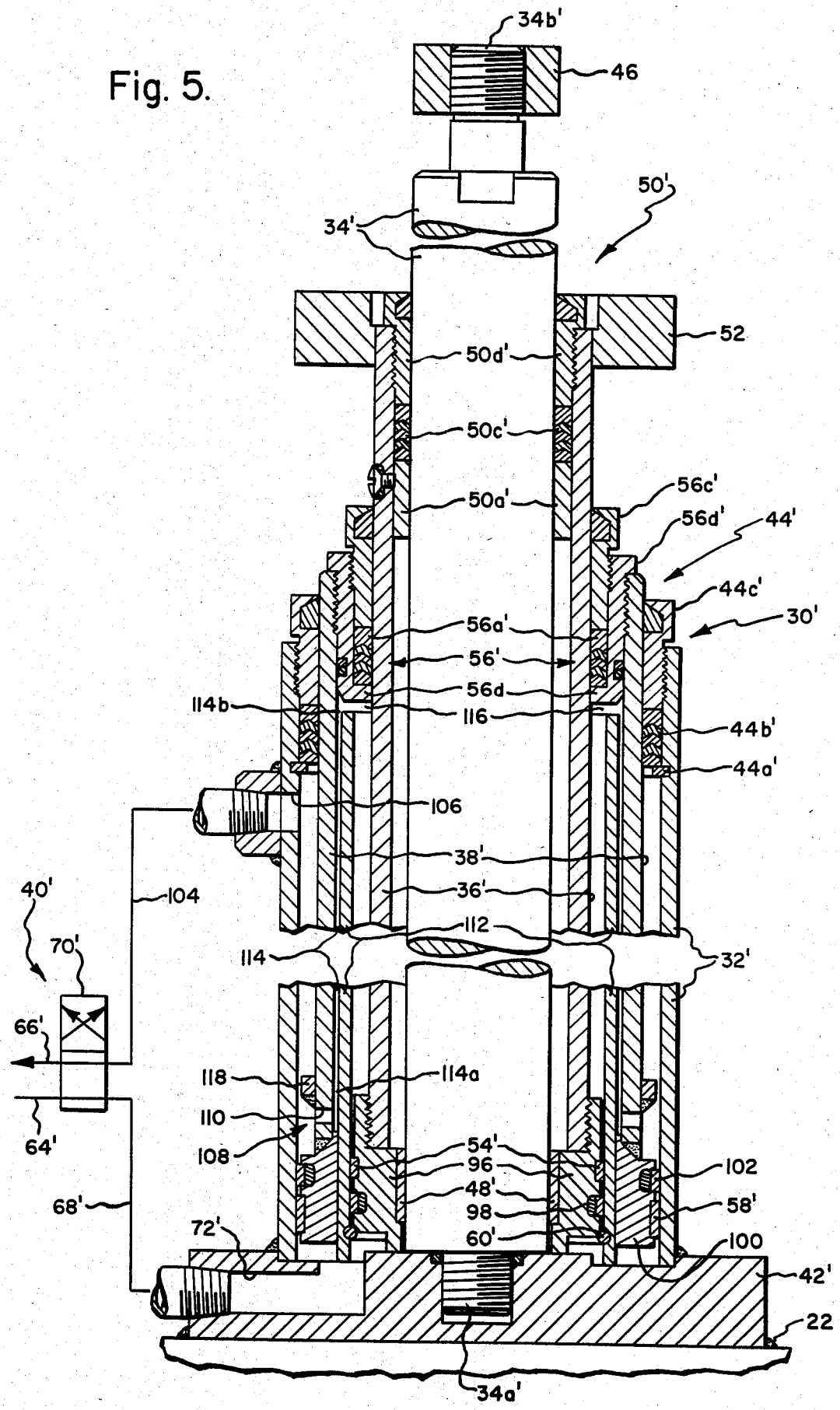
FIG. 5 is an enlarged vertical sectional view of a double acting version of the hydraulic cylinder device shown in FIG. 1.

Reference is now made to FIG. 5, wherein a second embodiment of the cylinder device of the present invention is designated as 30′ and prime numerals are employed to designate elements thereof, which are similar to those of cylinder device 30. More specifically, cylinder device 30′ is shown as generally including a hollow metal casing 32′; a rigid, elongated metal rod 34′; first and second open ended, metal cylinders 36′ and 38′; and fluid control means 40′ for introducing hydraulic fluid into and withdrawing such fluid from casing 32′. Casing 32′ has one end thereof, such as a lower end, closed by a metal mounting block 42′ suitably fixed to both the casing and stationary plate 22, as by welding, and an other or upper end bounded by a fluid packing gland and slide bearing device 44′ defined by a snap ring 44*a*′, packing rings 44*b*′ and a threadably mounted clamping-bearing ring 44*c*′. Rod 34′ is arranged to extend lengthwise and concentrically of casing 32′ and includes a first or lower end rigidly fixed to mounting block 42′, such as by a screw threaded connection 34*a*′, and second or upper end rigidly fixed to the upper end of column 24, such as by cantilever arm 46 and a threaded connection 34*b*′.

The lower and upper ends of cylinder 36', as viewed in FIG. 5, are slidably supported on rod 34' by supporting means including a lower bearing ring 48' and an upper fluid packing gland and slide-bearing device 50' defined for instance by an inner bearing ring **50*a'*, fluid packing rings 50*c'* and an outer threadably mounted, clamping-bearing ring 50*d'*. Bearing rings 48' and 50*a'* may be suitably fixed in place relative to cylinder 36', such as by means of an interference fit or snap ring retainers, not shown. As in the case of cylinder 36, cylinder 36' may have its second or outer end rigidly connected to shell 14 of the installation shown in FIG. 1 or removably connected to basket 88 of the installation shown in FIG. 3 or connected to cross beam 94 of the installation of FIG. 4**.

Cylinder 36' is slidably supported relative to casing 32' by supporting means including second cylinder 38'. Additionally, such supporting means includes a lower, outer bearing ring 54' carried by the inner or lower end of cylinder 36' and a fluid packing gland and slide-bearing device 56' defined for instance by fluid packing rings **56*a'* and an outer threadably mounted clamping-bearing ring 56*c'*, which cooperate to guide and provide a fluid seal between cylinders 36' and 38'. The illustrated construction of cylinder device 36' differs from that described with reference to cylinder 36 in the division of a threadably supported spacer element 56*d*, which carries ring 56*c'* and replaces snap ring 56*b* for purposes of defining the extended position of cylinder 36' and cooperating with ring 56*c'* to clamp packing rings 56*a'* therebetween. Cylinder 36' also differs from cylinder 36 in that its inner end is fitted with annular element 96, which defines an enlarged piston head means serving to mount rings 48' and 54', as well as an additional seal device 98**.

Cylinder 38' has its outer surface slidably supported relative to casing 32' by means of the above mentioned slide bearing device 44' and a lower bearing ring 58' carried adjacent its lower end for sliding engagement with casing 32'. As in the case of cylinder 36', outermost cylinder 38' has its lower end fitted with an annular element 100, which defines an enlarged piston head means serving to mount ring 58', as well as an additional seal device 102. Further, in the construction illustrated in FIG. 5, a rigid abutment in the form of a snap ring 60' is affixed inwardly of element 100 for abutting engagement with the lower end of cylinder 36'.

Fluid control means 40' is shown in FIG. 5 as including a fluid supply conduit 64' adapted to be connected to a suitable source of operating fluid, not shown; a dump or drain conduit 66'; a first supply-discharge conduit 68' disposed in flow communication with the interior of casing 32' via an opening 72' arranged adjacent the closed lower end thereof; a second supply-discharge conduit 104 disposed in flow communication with the interior of casing 32' via an opening 106 arranged adjacent the open end thereof; a suitable control valve 70' for alternatively placing the first and second conduits in flow communication with conduit 64' and 66'; and flow passage means 108 for placing second conduit 104 in flow communication with cylinder 36' intermediate the inner and outer ends thereof. Flow passage means 108 is preferably defined by at least one aperture 110, which is arranged to communicate with second conduit 104 and to extend through cylinder 38' adjacent element 100; and a sleeve device 112, which is fixed to element 100 concentrically inwardly of cylinder 38' and to extend towards the outer end thereof. Sleeve 112 defines a slide support for cylinder 36' and cooperates with its associated cylinder 38' to define an annular flow path 114 communicating at its inner end **114*a* with aperture(s) 110 and at its outer or opposite end 114*b* with cylinder 36' intermediate its inner and outer ends via an annular opening 116 defined by the upper end of sleeve 112 and spacer element 56*d*. In order to prevent blockage of aperture 110 by packing rings 44*b'* as an incident to movement of cylinder 38' into its fully extended position, suitable means such as an abutment ring 118 is suitably fixed, as by welding, to the inner end of cylinder 38' immediately adjacent aperture 110 and arranged for engagement with snap ring 44*a'***.

In the installation illustrated in FIG. 5, the coupling of first and second conduits 68' and 104 with supply and exhaust conduit 64' and 66', respectively, serves to drive cylinders 36' and 38' towards their maximum permissive extended positions, defined for example by engagement of element 96 and ring 118 with rings **56*d* and 44*a'*, respectively. Conversely, when fluid under pressure is introduced into casing 32' through second conduit 104 and withdrawn from such casing through first conduit 68', cylinders 36' and 38' are driven towards their fully retracted positions shown in FIG. 5, defined for example by the bottoming out of element 96 on abutment ring 60' and by the bottoming out of element 100 or sleeve 112 on base plate 42'. As in the case of single acting cylinder device 30, double acting cylinder device 30' may have associated therewith stop devices, not shown, adapted to limit the effective range of movement of cylinders 36' and 38' between their retracted and extended positions. As between cylinder devices 30 and 30'**, the former has the primary advantage of relatively low manufacturing cost and the latter has the primary advantage that its associated cylinders may be easily moved or driven into their retracted positions for all loading conditions thereof and thus not require the use of additional weights for relatively light loads.

Additional forms and variations of the present invention will likely occur to those skilled in the art on the basis of the foregoing description. Specifically, it is contemplated that cylinder devices 30 and 30' need not be limited to having two internal cylinders, but rather may employ one or three and possibly more of such cylinders depending upon the required length of travel of a load(s). Where a given installation employs three or more cylinders, all cylinders excluding the innermost cylinder may be of like construction differing only in length and diameter. Moreover, it is contemplated that the cylinder devices of the present invention may have utility in environments other than those which have been specifically illustrated in the drawings, such as for instance in any environment in which a load is required to be moved vertically and rigid structure is available or provided for attachment of one or more cylinder devices of the type disclosed herein. Still further, while it is preferable to rigidly attach the cylinder devices to a convenient, rigid support, as by threaded fasteners or by welding, it is contemplated that there may be instances where suitable hinge means can be employed to mount the cylinder devices.

What is claimed is:

1. A fluid operated cylinder adapted for moving a load relative to a load supporting means, said cylinder comprising:

a hollow casing having a closed end for attachment to one of said load and said load supporting means and an open end;

an elongated rod extending lengthwise relative to said casing, said rod having a first end arranged within said casing and rigidly fixed to said closed end of said casing and a second end arranged outwardly of said open end of said casing for attachment to said one of said load and said load supporting means;

at least one open ended fluid operated cylinder, said cylinder is arranged intermediate said casing and said rod and has a first end arranged within said casing and a second end disposed outwardly thereof intermediate said open end of said casing and said second end of said rod, said second end of said cylinder having means for attaching same to the other of said load and said load supporting means;

cylinder supporting means for supporting outer and inner surfaces of said cylinder relative to said casing and said rod to permit sliding movements of said cylinder lengthwise thereof between retracted and extended positions in which said cylinder is disposed relatively adjacent said first and second ends of said rod, respectively; and fluid means for introducing fluid into and withdrawing fluid from said casing for effecting movement of said cylinder between said retracted and extended positions thereof for moving said load relative to said load supporting means.

2. A fluid operated cylinder according to claim 1, wherein said cylinder supporting means includes at least one other fluid operated cylinder arranged intermediate said one cylinder and said casing and means for supporting outer and inner surfaces of said other cylinder relative to said casing and said one cylinder to permit sliding movements of said other cylinder relative to said one cylinder, said casing and said rod between retracted and extended positions incident to introduction of said fluid into and withdrawal of fluid from said casing.

3. A fluid operated cylinder according to claim 2, wherein said other cylinder has means for affixing same to another load to be moved relative to said load supporting means.

4. A fluid operated cylinder adapted for moving a load relative to a load supporting means, said cylinder comprising:

a hollow casing having a closed end for attachment to one of said load and said load supporting means and an open end;

an elongated rigid rod extending lengthwise concentrically of said casing, said rod having a first end arranged within said casing and fixed to said closed end and a second end arranged outwardly of said open end for attachment to said one of said load and said load supporting means;

at least two mutually slidably supported cylinders including an innermost cylinder slidably supported by said rod and an outermost cylinder slidably supported by said casing, each of said cylinders having a first end arranged within said casing and a second end arranged outwardly of said casing intermediate said open end and said second end of said rod, said casing having means carried adjacent said closed and open ends for cooperation with means carried adjacent said first end of said outermost cylinder for defining retracted and extended positions of said outermost cylinder relative to said casing, said outermost cylinder and each cylinder intermediate said outermost and innermost cylinders carrying means adjacent said first and second means thereof for cooperating with means carried on said first end of a next adjacent inner cylinder for defining retracted and extended positions of said next adjacent inner cylinder, said second end of one of said cylinders being adapted for attachment to the other of said load and said load supporting means; and fluid means for introducing fluid into and withdrawing fluid from said casing for effecting movement of said cylinders between said retracted and extended positions thereof for moving said load relative to said load supporting means.

5. A fluid operated cylinder according to claim 4, wherein said fluid means introduces fluid into said closed end of said casing for driving said cylinders into said extended positions thereof and withdraws fluid from said closed end of said casing for permitting the weight of said load to move said cylinders into said retracted positions thereof.

6. A fluid operated cylinder according to claim 4, wherein said fluid means includes a first conduit connected into said casing adjacent said closed end for flow communication with said first end of each of said cylinders, a second conduit connected into said casing adjacent said open end thereof for flow communication with said outermost cylinder intermediate said first and second ends thereof, flow passage means for each said outermost cylinder and cylinders intermediate said outermost and innermost cylinders for placing said second conduit in flow communication with a next adjacent inner cylinder intermediate said first and second ends thereof, and valve means for controlling flow of fluid through said first and second conduits, for introducing and withdrawing fluid alternately with respect to said closed and open ends of said casing for driving said cylinders alternately between said retracted and extended positions thereof.

7. A fluid operated cylinder according to claim 6, wherein each said passage means includes at least one aperture communicating with said second conduit and extending through its associated cylinder adjacent said means carried by said first end thereof and sleeve means fixed to said means carried on said first end thereof concentrically inwardly of its associated cylinder, said sleeve means defining a slide support for said first end of said next adjacent inner cylinder and cooperating with its associated cylinder to define a flow path communicating at one end thereof with said aperture and communicating at an opposite end thereof with said next adjacent inner cylinder intermediate said first and second ends thereof.

8. The combination of a load, a load supporting means and at least two fluid operated cylinder devices arranged in parallel and operably lifting said load relative to said load supporting means, each of said cylinder devices comprising:

a hollow casing having an open end and a closed end attached to one of said load and load supporting means;

an elongated rod extending lengthwise relative to said casing, said rod having a first end arranged within said casing and rigidly fixed to said closed end of said casing and a second end arranged outwardly of said open end of said casing and attached to said one of said load and load supporting means;

at least one open ended fluid operated cylinder, said cylinder is arranged intermediate said casing and said rod and has a first end arranged within said casing and a second end disposed outwardly thereof intermediate said open end of said casing and said second end of said rod, said second end of said cylinder is attached to the other of said load and load supporting means and said second end of said cylinder of each of said cylinder devices are rigidly attached together;

cylinder supporting means for supporting outer and inner surfaces of said cylinder relative to said casing and said rod to permit sliding movements of said cylinder lengthwise thereof between retracted and extended positions in which said cylinder is disposed relatively adjacent said first and second ends of said rod, respectively; and fluid means for introducing fluid into and withdrawing fluid from said casing for effecting movement of said cylinder between said retracted and extended positions.

9. The combination according to claim 8, wherein said cylinder supporting means includes at least one other fluid operated cylinder arranged intermediate said one cylinder and said casing and means for supporting outer and inner surfaces of said other cylinder relative to said casing and said one cylinder to permit sliding movements of said other cylinder lengthwise thereof relative to said casing, said rod and said one cylinder incident to introduction of said fluid into and withdrawal of fluid from said casing.

10. The combination according to claim 9, wherein said casing and said rod are attached to said load supporting means and said one cylinder is attached to said load.

11. The combination according to claim 8, wherein said fluid means introduces fluid into said closed end of said casing for driving said one cylinder into said extended position and withdraws fluid from said closed end of said casing for permitting the weight of said load to move said one cylinder into said retracted position.

12. The combination according to claim 8, wherein said cylinder supporting means includes at least one other fluid operated cylinder arranged intermediate said one cylinder and said casing and means for supporting outer and inner surfaces of said other cylinder relative to said casing and said one cylinder to permit sliding movements of said other cylinder lengthwise thereof relative to said casing, said rod and said one cylinder, said other cylinder having a first end arranged within said casing and a second end disposed outwardly thereof intermediate said open end of said casing and said second end of said first cylinder, said other cylinder carrying inner motion limiting means adjacent said first and second ends thereof and outer motion limiting means adjacent said first end thereof, said one cylinder carrying outer motion limiting means adjacent said first end thereof, said outer motion limiting means of said one cylinder being arranged for alternate engagement with said inner motion limiting means carried adjacent said first and second ends of said other cylinder to define the maximum permissible extent of movement of said one cylinder relative to said other cylinder, said outer motion limiting means of said other cylinder being arranged for alternate engagement with said closed and open ends of said casing or said inner motion limiting means of a further other cylinder arranged intermediate said other cylinder and said casing to define the maximum permissible extent of movement of said other cylinder relative to said casing; and said fluid means includes a first conduit connected into said casing adjacent said closed end thereof for flow communication with said first ends of said one and said other cylinders, a second conduit connected into said casing adjacent said open end thereof for flow communication with said other cylinder intermediate said first and second ends thereof, flow passage means extending through said other cylinder for placing said second conduit in flow communication with said one cylinder intermediate said first and second ends thereof, and valve means for controlling flow of fluid through said first and second conduits to introduce and withdraw fluid alternately with respect to said closed and open ends of said casing.

* * * * *

UNITED STATES PATENT AND TRADEMARK OFFICE

CERTIFICATE OF CORRECTION

PATENT NO. : 4,567,811

DATED : February 4, 1986

INVENTOR(S) : Henry J. Piegza et al

It is certified that error appears in the above-identified patent and that said Letters Patent are hereby corrected as shown below:

Col. 3, line 29 - "the" should be --and--.

Col. 4, line 12 - "alternatively" should be --alternately--.

Col. 4, line 14 - "cyllinder" should be --cylinder--.

Col. 4, line 16 - "alternatively" should be --alternately--.

Col. 4, line 25 - "alternatively" should be --alternately--.

Col. 6, line 14 - "sealed" should be --seated--.

Col. 6, line 25 - "82" should be --92--.

Col. 7, line 26 - "division" should be --provision--.

Col. 10, line 2 - "means" should be --ends--.

Signed and Sealed this

*Thirteenth* Day of *May 1986*

[SEAL]

*Attest:*

DONALD J. QUIGG

*Attesting Officer*

*Commissioner of Patents and Trademarks*